United States Patent [19]

Sogawa

[11] Patent Number: 4,730,590

[45] Date of Patent: Mar. 15, 1988

[54] AIR-FUEL RATIO CONTROL SYSTEM FOR AN ENGINE

[75] Inventor: Yoshiyuki Sogawa, Hachiohji, Japan

[73] Assignee: Fuji Jukogyo Kabushiki Kaisha, Tokyo, Japan

[21] Appl. No.: 35,640

[22] Filed: Apr. 3, 1987

[30] Foreign Application Priority Data

Apr. 9, 1986 [JP] Japan ..... 61-083119

[51] Int. Cl.[4] ..... F02M 51/00

[52] U.S. Cl. ..... 123/489; 123/480; 123/486

[58] Field of Search ..... 123/440, 478, 480, 486, 123/489; 364/431.05

[56] References Cited

U.S. PATENT DOCUMENTS 4,483,301 11/1984 Yamada et al. ..... 123/478 X
4,499,880 2/1985 Miki et al. ..... 123/489
4,512,313 4/1985 Tsuchida et al. ..... 123/489 X
4,526,001 7/1985 Burns et al. ..... 123/489 X
4,528,961 7/1985 Katoh et al. ..... 123/489

FOREIGN PATENT DOCUMENTS 0136519 4/1985 European Pat. Off. ..... 123/489
00048749 3/1983 Japan .
00059330 4/1983 Japan .

*Primary Examiner*—Willis R. Wolfe
*Attorney, Agent, or Firm*—Martin A. Farber

[57] ABSTRACT

An air-fuel ratio feedback control system is provided with a look-up table storing a plurality of time data dependent on an engine operating condition. The time is decided to correspond to a control delay time of the control system. When a desired air-fuel ratio varies, feedback operation is stopped for a time derived from the look-up table.

4 Claims, 6 Drawing Figures

AIR-FUEL RATIO CONTROL SYSTEM FOR AN ENGINE

BACKGROUND OF THE INVENTION

The present invention relates to an air-fuel ratio control system for an engine of a motor vehicle, and more particularly for a lean mixture engine.

The lean mixture engine operates on lean mixture at light and middle load and on stoichiometry mixture at heavy load. A feedback air-fuel ratio control is provided for supplying the air-fuel mixture at large air-fuel ratio (lean mixture) or stoichiometric air-fuel ratio in accordance with engine operating conditions.

The feedback system is provided with a lean mixture sensor for sensing the oxygen concentration of the exhaust gas of the engine, the output voltage of which is proportional to the oxygen concentration. In a fuel injection system for the lean mixture engine, a plurality of desired air-fuel ratios are stored in a look-up table in accordance with engine operating conditions. A feedback signal from the lean mixture sensor is compared with a desired air-fuel ratio AFd to produce an error signal. A feedback coefficient $K_{FB}$ for fuel injection is calculated based on the error signal. On the other hand, an air-fuel ratio coefficient $K_{AF}$ and a miscellaneous coefficient COEF including a plurality of coefficients based on various operating conditions such as coolant temperature, intake air temperature and others are obtained. Fuel injection time TI of injected fuel is calculated as follows.

$$TI = K \times K_{AF} \times K_{FB} \times Q/N \times COEF$$

where

K is a correcting coefficient,

Q is intake air flow rate,

N is engine speed.

By injecting fuel during the calculated time, air-fuel ratio is controlled to the desired air-fuel ratio.

When the desired air-fuel ratio AFd varies from one value to another value dependent on changing of engine operating condition during the looking-up the table, the control of air-fuel delays. As a result, the control system oscillates, so that actual air fuel ratio AFa oscillates as shown in FIG. 6.

SUMMARY OF THE INVENTION

The object of the present invention is to provide a system which may control the air-fuel ratio without oscillating the system.

In accordance with the present invention, when the desired air-fuel ratio varies from one value to another value dependent on changing of engine operating condition during the looking-up the table, the feedback control operation is stopped for a time which is decided by a delay time dependent on engine operating conditions. The delay time is the sum of a transport time delay and a first-order lag of the system. The transport time delay is a period from the time when the desired air-fuel ratio varies to the time when the change of oxygen concentration in the exhaust gas in accordance with the change of the desired ratio is sensed by the lean mixture sensor. When the desired air-fuel ratio does not vary during the time, the feedback control operation is restarted.

According to the present invention, there is provided an air-fuel ratio control system for an engine, comprising sensing means for sensing engine operating conditions and for producing operating condition signals, a sensor provided for sensing oxygen concentration of exhaust gas of the engine and for producing a feedback signal dependent on the concentration, first means responsive to the operating condition signals for producing a desired air-fuel ratio signal, second means for comparing the feedback signal with the desired air-fuel ratio signal and for producing an error signal, control means responsive to the error signal for deciding amount of fuel supplied to the engine, third means for detecting variation of the desired air-fuel ratio and for producing a variation signal, a look-up table provided for storing a plurality of time data dependent on engine operating condition, the time data being decided to correspond to a control delay time of the control system, fourth means responsive to the variation signal for fixing the error signal for a period derived from the look-up table.

In an aspect of the invention, the sensor is a lean mixture sensor for sensing oxygen concentration in burnt exhaust gas of lean mixture, and the delay time is the sum of a transport time delay and first-order lag.

The other objects and features of this invention will be apparently understood from the following description with reference to the accompanying drawings.

DETAILED DESCRIPTION OF THE PREFERRED EMBODIMENT

Figure 1:
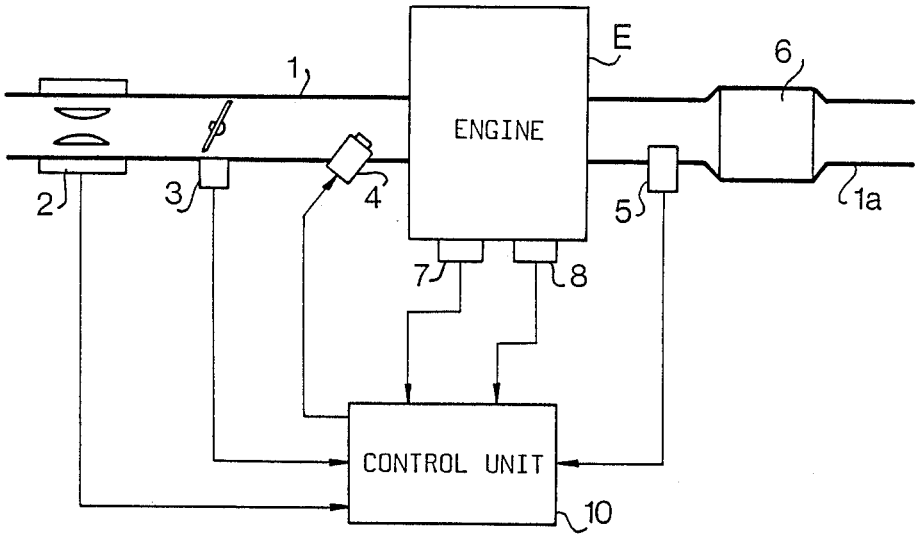
FIG. 1 is a schematic diagram showing a control system of the present invention.
Figure 2:
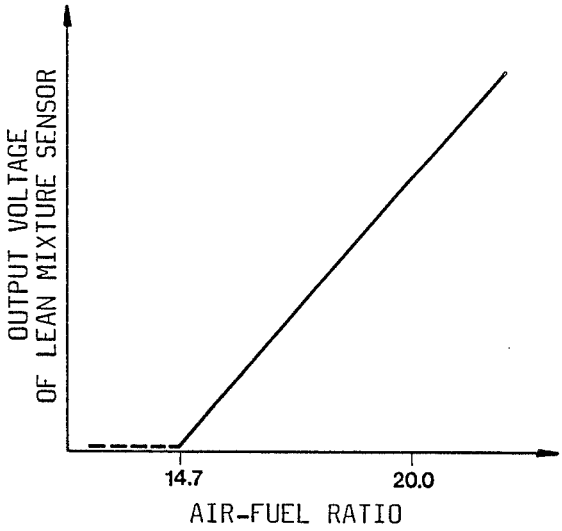
FIG. 2 is a graph showing an output characteristic of a lean mixture sensor.

Referring to FIG. 1, an air flow meter 2 for producing an air flow signal Q, throttle position sensor 3 and fuel injector 4 are mounted on an intake pipe 1 of an engine E. In an exhaust pipe 1*a*, a lean mixture sensor 5 and a catalytic converter 6 are provided. Mounted on the engine E are a coolant temperature sensor 7 and a crankangle sensor 8 which produces an engine speed signal N. Output signals of those sensors are applied to a control unit 10. As shown in FIG. 2, the output voltage of the lean mixture sensor 5 is proportional to the air-fuel ratio of lean mixture.

Figure 3:
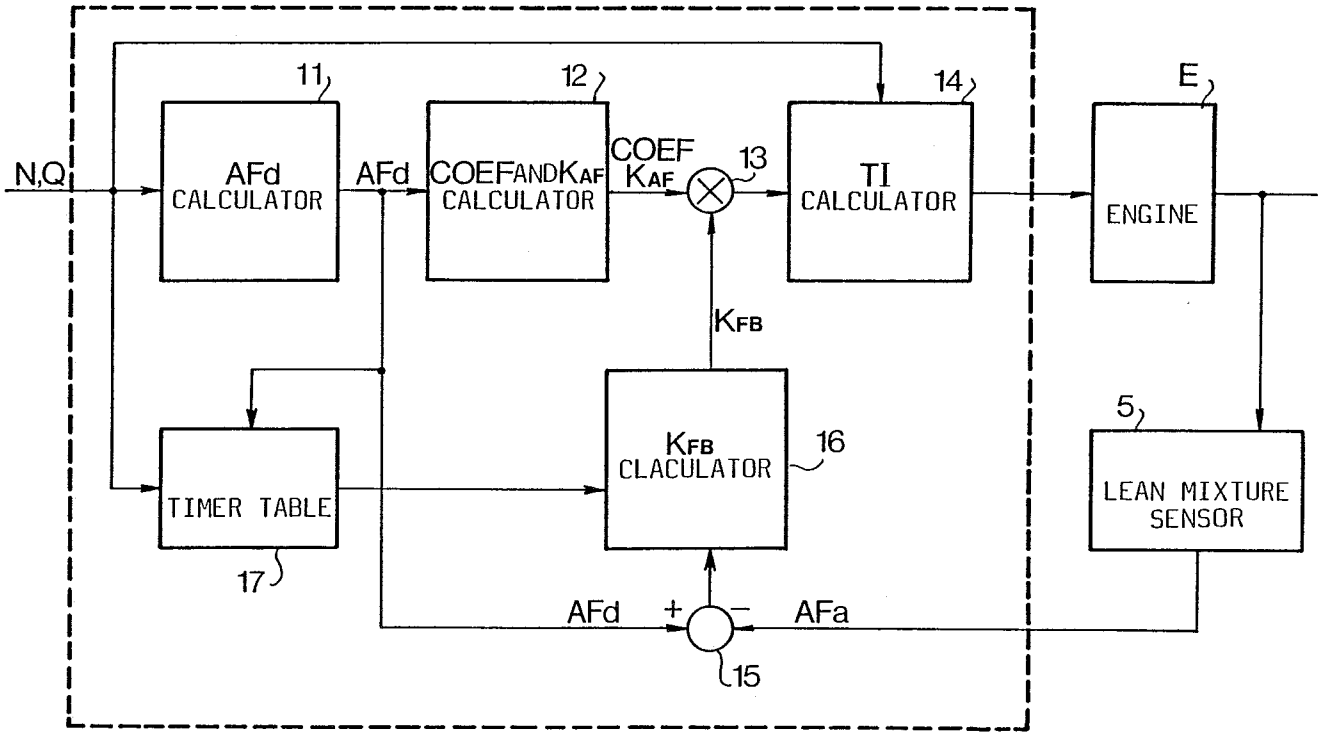
FIG. 3 is a block diagram showing the control system of the present invention.

FIG. 3 shows the control unit 10. The control unit 10 has a desired air-fuel ratio table 11 from which a desired air-fuel ratio AFd is derived. The desired air-fuel ratio AFd is applied to an air-fuel ratio coefficient $K_{AF}$ and miscellaneous coefficient COEF calculator 12, to an adder 15, and to a feedback stopping timer look-up table 17. The adder 15 produces an error signal dependent on the difference between the desired air-fuel ratio AFd and the actual air fuel ratio AFa calculated from the feedback signal from the lean mixture sensor 5. The error signal is applied to a feedback coefficient calculator 16 which produces a feedback coefficient $K_{FB}$. On the other hand, the timer table 17 stores a plurality of stop periods dependent on engine operating conditions such as engine speed N and intake air flow rate Q. As described hereinbefore, the stopping period is the sum of the transport time delay and the first-order lag. The timer table 17 produces a stop period signal in response to the variation of the desired air-fuel ratio, for temporaril stopping the feedback operation at the changing of the desired air-fuel ratio caused by changing of engine operating conditions.

The coefficients $K_{AF}$, COEF and $K_{FB}$ are multiplied at a multiplier 13 and the product is applied to a fuel injection time calculator 14 where the above described calculation TI is made to produce a fuel injection signal. The fuel injection signal is applied to an engine E to inject fuel during the time TI.

Figure 4:
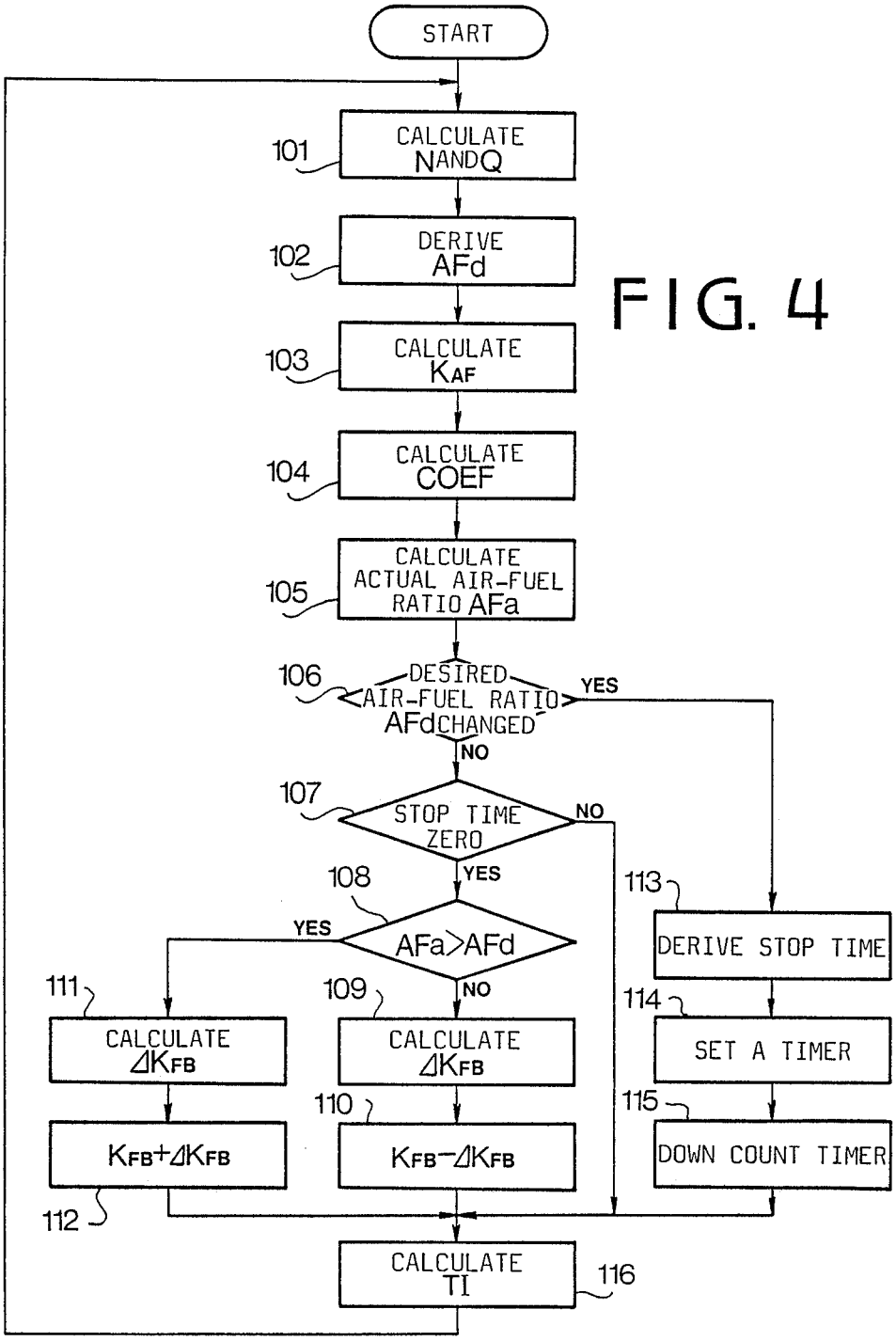
FIG. 4 is a flowchart showing the operation of the system.

FIG. 4 shows the operation of the system. From a step 101 to a step 105 shows the above described operations for obtaining the various data. When the desired air-fuel ratio AFd does not change and the output timer table 17 is zero (steps 106, 107), the comparison of AFd and AFa is made at a step 108. In accordance with the result of the comparison, the feedback coefficient $K_{FB}$ is corrected at steps 109 to 112, and fuel injection time TI is calculated at a step 116. When the desired air-fuel ratio changes, the stopping period is derived from the table 17 at a step 113 and the feedback coefficient $K_{FB}$ is fixed to the value before the changing of the desired air-fuel ratio. Thus, the feedback operation is stopped during the set period and the fuel injection period is calculated based on the fixed value of $K_{FB}$. If the variation of the desired air-fuel ratio has ceased during the set time, the feedback operation is restarted.

Figure 5:
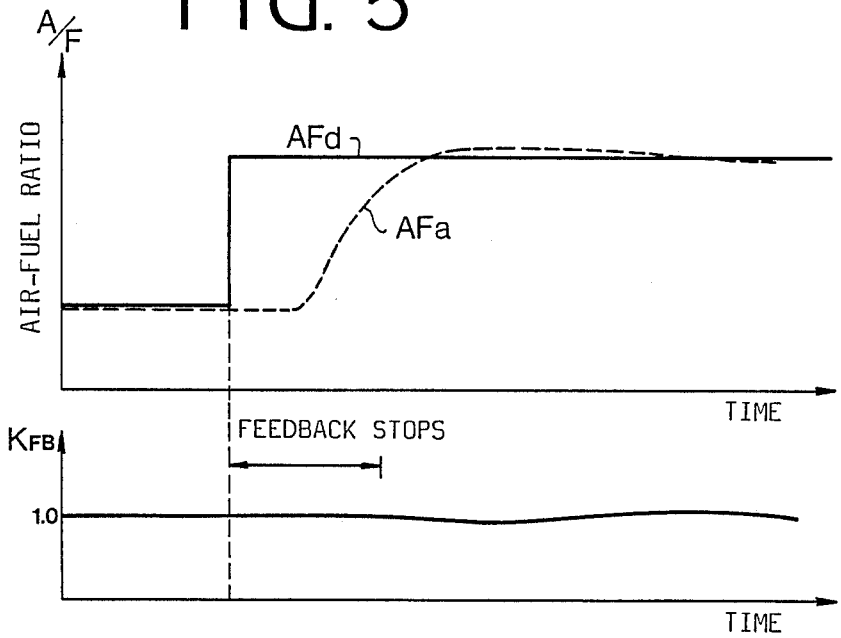
FIGS. 5 and 6 are graphs showing variations of air-fuel ratios in the system of the present invention and in a conventional system.
Figure 6:
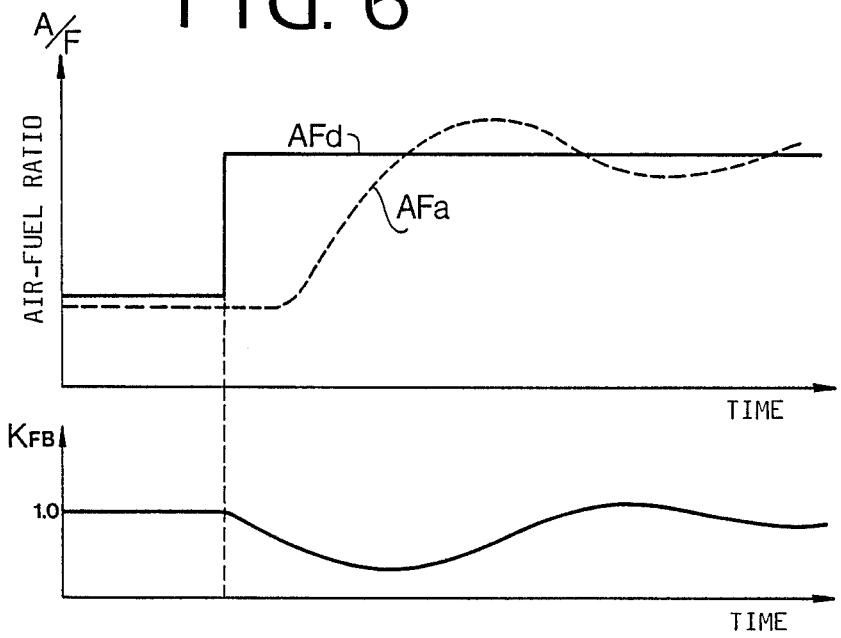

Thus, in accordance with the present invention, since feedback operation is the stopping period corresponding to a control delay time which causes the oscillation of the system, the air-fuel ratio AFa is converged to the desired air-fuel ratio AFd since the feedback coefficient $K_{FB}$ is fixed to the value without oscillating as shown in FIG. 5.

While the presently referred embodiment of the present invention has been shown and described, it is to be understood that this disclosure is for the purpose of illustration and that various changes and modifications may be made without departing from the spirit and scope of the invention as set forth in the appended claim.

What is claimed is:

1. An air-fuel ratio control system for an engine, comprising sensing means for sensing engine operating conditions and for producing operating condition signals;

a sensor sensing oxygen concentration of exhaust gas of the engine and producing a feedback signal dependent on the concentration;

first means responsive to the operating condition signals for producing a desired air-fuel ratio signal;

second means for comparing the feedback signal with the desired air-fuel ratio signal and for producing an error signal;

control means responsive to the error signal for deciding amount of fuel supplied to the engine;

third means for detecting variation of the desired air-fuel ratio and for producing a variation signal;

a look-up table storing a plurality of time period data dependent on an engine operating condition, the time period being decided to correspond to a control delay time of the control system;

fourth means responsive to the variation signal for fixing the error signal for a time period derived from the look-up table.

2. The system according to claim 1 wherein the sensor is a lean mixture sensor for sensing oxygen concentration in burnt exhaust gas of lean mixture.

3. The system according to claim 1 wherein the control means is means for calculating fuel injection time.

4. The system according to claim 1 wherein the delay time is the sum of a transport time delay and first-order lag.

* * * * *